US009214086B1

(12) United States Patent
Onishi

(10) Patent No.: US 9,214,086 B1
(45) Date of Patent: Dec. 15, 2015

(54) VEHICLE TO VEHICLE WIRELESS COMMUNICATION APPARATUS WITH POTENTIAL CRASH WARNING

(71) Applicant: Alpine Electronics, Inc., Tokyo (JP)

(72) Inventor: Hirofumi Onishi, Torrance, CA (US)

(73) Assignee: Alpine Electronics, Inc., Tokyo (JP)

( * ) Notice: Subject to any disclaimer, the term of this patent is extended or adjusted under 35 U.S.C. 154(b) by 57 days.

(21) Appl. No.: 14/292,154

(22) Filed: May 30, 2014

(51) Int. Cl.
*G08G 1/09* (2006.01)
*G08G 1/0967* (2006.01)

(52) U.S. Cl.
CPC ..... *G08G 1/096791* (2013.01)

(58) Field of Classification Search
CPC ..... G07C 5/008; G08G 1/161
USPC ..... 340/905, 988, 990, 902, 903; 701/51, 701/55, 446, 448; 455/3.05, 411; 370/231, 370/235
See application file for complete search history.

(56) References Cited

U.S. PATENT DOCUMENTS

2009/0292459 A1* 11/2009 Zuccotti et al. ..... 701/200
2010/0253593 A1* 10/2010 Seder et al. ..... 345/7

FOREIGN PATENT DOCUMENTS

JP 2005-204218 7/2005
JP 2008-236409 10/2008
JP 2009-231996 10/2009

* cited by examiner

*Primary Examiner* — Toan N Pham
(74) *Attorney, Agent, or Firm* — Muramatsu & Associates

(57) ABSTRACT

A wireless communication device for vehicle-to-vehicle communication includes a vehicle positioning module that uses sensors and detects a current position and a direction of the vehicle. In a map matching, pre-calculated route information and road network information based on the current position are retrieved from map data and a current link of the vehicle is identified and a potential signal pattern is determined regarding a position of next intersection and the road network information based on the current position, the direction of the vehicle and the current link. Based on the potential signal pattern, radio characteristics including a level of intensity, a frequency, and a direction are assigned. A transmitter produces a radio signal of the radio characteristics carrying the current position, the speed and the direction of the vehicle. An antenna module converts the radio signal from the transmitter into radio waves and radiates the radio waves.

20 Claims, 9 Drawing Sheets

(a) Vehicle 1 (b) Vehicle 2 (c) Building-case 1 (d) Building-case 2 (e) Building-case 3

(a) Propagation of 700 MHz (b) Propagation of 5.8 GHz

VEHICLE TO VEHICLE WIRELESS COMMUNICATION APPARATUS WITH POTENTIAL CRASH WARNING

BACKGROUND

1. Field

The present disclosure relates to a device and method of wireless communication for vehicle-to-vehicle (V2V) communication in a vehicle. More specifically, embodiments in the present disclosure relate to a device and method of wireless V2V communication with switching among a plurality of radio transmission configurations depending on assumed a positional relationship between a signal transmitting vehicle and a signal receiving vehicle, and signal environmental factors, such as potential obstacles and geographical surroundings.

2. Description of the Related Art

Frequently, in vehicle-to-vehicle and vehicle-to-infrastructure (V-to-X) communication, communication failure may occur with high possibility mainly because of weak radio propagation when obstacles are located on a communication path. Radio propagation degradation has been believed to be relatively large when any large obstacles are located on a communication path, thus an increase of radio output intensity and/or replacement of a radio frequency to that of lower frequency channel with low directionality have been considered as appropriate implementation. There have been several methods of switching between a plurality of radio frequency bands proposed that enable lower frequency channels with low directionality. For example, Japanese patent publications JP 2005-204218 and JP 2008-236409 teach that it is effective to switch between two frequency bands for transmission with other vehicles in the vicinity, considering information regarding surrounding vehicle information and surrounding buildings available from map database. Another Japanese patent publication, JP 2009-231996, further teaches switching between two frequency bands depending on visual information available by capturing images of surrounding objects that possibly become obstacles.

However, too strong radio propagation by large radio output intensity or low radio frequency is likely to interfere to communications between neighboring vehicles (i.e. in freeways or urban intersections) or other communications with adjacent frequencies. It is especially true when the vehicle is approaching to an area where many vehicles are approaching and leaving, such as an intersection, an end of a slope where deceleration tends to occur, freeway exits and junctions, etc. In order to avoid radio interference to communications with neighboring vehicles in such a congested area, the usage of the increase of radio output intensity and/or replacement of the radio frequency to that of lower frequency channel is preferably limited, to reduce unnecessary communications of other vehicles in the vicinity that are not the designated counterpart of the vehicle's communication.

Accordingly, there is a need to provide a method and device that allows a vehicle to wirelessly communicate with other vehicles with effective frequency and intensity switching of its radio signals while reducing redundant communication due to lower frequency and high intensity signals and resulting in minimizing radio signal interference to a traffic congested area.

SUMMARY

In one aspect, a wireless communication device for vehicle-to-vehicle communication in a first vehicle is provided. The wireless communication device for vehicle-to-vehicle communication includes a vehicle positioning module that receives at least one of a speed of the first vehicle, a gyro signal, and a global positioning system (GPS) signal from one or more sensors and detects a current position of the first vehicle and a direction of the first vehicle, and storage that stores map data. A map matching module retrieves pre-calculated route information and road network information based on the current position of the first vehicle from the stored map data and identifies a current link having the current position of the first vehicle. A signal pattern calculation module receives the current position of the first vehicle, the speed of the first vehicle, the direction of the first vehicle, and the current link from the map matching module, a position of next intersection and the road network information based on the received current position of the first vehicle the direction of the first vehicle, the current link from the map matching module, and determines a potential signal pattern based on the received information. A radio parameter controller receives the potential signal pattern from the signal pattern calculation module, assigns a level of radio intensity, a radio frequency, and a direction of a radio signal based on the potential signal pattern, and controls the level of radio intensity, the radio frequency, and the direction of radio signal to be transmitted. A transmitter produces a radio signal of the radio intensity, the radio frequency, and the direction of radio signal assigned by the radio parameter controller, where the radio signal carries the current position of the first vehicle, the speed of the first vehicle, and the direction of the first vehicle. An antenna module includes a plurality of antennas, and converts the radio signal from the transmitter into radio waves and radiates the radio waves.

In another aspect, a transmission method of wireless vehicle-to-vehicle communication is provided. This method includes receiving at least one of a speed of a vehicle, a gyro signal, and a global positioning system (GPS) signal from one or more sensors. A current position of the vehicle and a direction of the vehicle are detected. Pre-calculated route information and road network information are retrieved based on the current position of the vehicle from map data in storage. A current link having the current position of the vehicle is identified in a process of map matching. The current position of the vehicle, the speed of the vehicle, the direction of the vehicle and the current link identified, a position of next intersection and the road network information based on the received current position of the vehicle, the direction of the vehicle, the current link are received and a potential signal pattern is determined based on the position of next intersection, the current position of the vehicle, the speed of the vehicle, the direction of the vehicle, the current link, and the road network information. A first level of radio intensity, a first radio frequency, and a first direction of a radio signal are assigned and controlled based on the potential signal pattern determined. With controlling the first level of radio intensity, the first radio frequency, and the first direction of the radio signal, the radio frequency signal having the current position of the vehicle, the speed of the vehicle, and the direction of the vehicle is produced at a transmitter. After converting the radio frequency signal into radio waves, the radio waves is radiated from one or more antennas. In one embodiment, while assigning the level of radio intensity, the radio frequency, and the direction of the radio signal based on the potential signal pattern, a second level of radio intensity higher than the first level of radio intensity and a second radio frequency lower than the first radio frequency to a radio signal with a direction to an area within a predetermined distance from the next intersection on an intersecting street at the next intersection are assigned when the potential signal pattern is indicative that the vehicle arriving at the next intersection within a threshold time, and the first level of radio intensity and the first radio frequency to the radio signal addressing to a second vehicle travelling on a street are assigned where the vehicle is travelling when an obstacle is in between the vehicle and the second vehicle.

In one embodiment, the direction of the radio signal is controlled by switching among a plurality of antennas of a plurality of directions. In another embodiment, the direction of the radio signal is controlled by beam foaming.

In one embodiment, radio propagation information is received from a map database for calculating the signal pattern and the potential signal pattern is determined based on the radio propagation information.

In one embodiment, the wireless communication device further includes a radio propagation information generating module that creates radio propagation information based on received information from a map database, and the potential signal pattern is determined based on the radio propagation information. In one embodiment, the radio propagation information is based on three dimensional information comprising at least one of terrain information, mountain polygonal information, city polygonal information and intersection information. In another embodiment, the radio propagation information is based on crash statistical information associated with location information. In another embodiment, the radio propagation information is based on weather statistical information associated with location information, and stored in the map database.

In one embodiment, the driving status information may be related to a driver action related to a sudden change of at least one of the speed of the vehicle and the direction of the vehicle, and the potential signal pattern is determined considering the driving status information which allows the radio parameter control module to control a direction and intensity based on the driving status information. In another embodiment, the first level of radio intensity and the first radio frequency to the radio signal with a direction rearward are assigned when the driving status information is indicative of the sudden decrease of the speed.

The above and other aspects, objects and advantages will be readily apparent from the following detailed discussion.

DETAILED DESCRIPTION OF THE PREFERRED EMBODIMENTS

Figure 1:
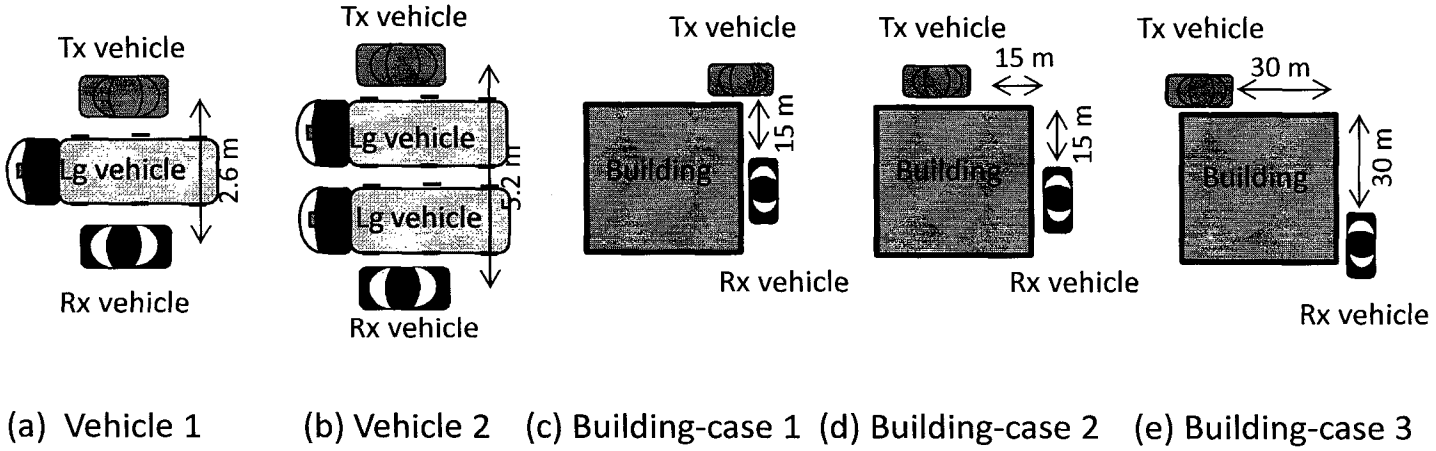
FIG. 1 is a set of sample positional relationship conditions for a signal loss measurement experiment.

Various embodiments for a wireless communication device and method for vehicle-to-vehicle communication in a vehicle with another vehicle will be described hereinafter with reference to the accompanying drawings. Unless defined otherwise, all technical and scientific terms used herein have the same meaning as commonly understood to one of ordinary skill in the art to which present disclosure belongs. Although the description will be made mainly for the case where the wireless communication device and method for vehicle-to-vehicle communication in the vehicle with another vehicle, any methods, devices and materials similar or equivalent to those described, can be used in the practice or testing of the embodiments. All publications mentioned are incorporated by reference for the purpose of describing and disclosing, for example, the designs and methodologies that are described in the publications which might be used in connection with the presently described embodiments. The publications listed or discussed above, below and throughout the text are provided solely for their disclosure prior to the filing date of the present disclosure. Nothing herein is to be construed as an admission that the inventors are not entitled to antedate such disclosure by virtue of prior publications.

In general, various embodiments of the present disclosure are related to a wireless communication device for vehicle-to-vehicle communication in a vehicle with another vehicle. Furthermore, the embodiments are related to a wireless communication method for vehicle-to-vehicle communication in a vehicle with another vehicle. Thus, the vehicle can share its own information with the other vehicle via vehicle-to-vehicle communication in order to achieve safe driving.

Sometimes dedicated short-range communications (DSRC) between a vehicle and its neighboring vehicles may fail due to various causes. First, obstacles on a communication path, such as trucks/busses or buildings, have been considered as a cause which results in limited radio propagation and degrades one of the most valuable benefits of DSRC wireless crash warning to assist detecting objects in blind spots of a DSRC receiver vehicle driver. Second, radio channel impairment from multipath fading or Doppler fading may cause communication failure. Third, radio interference from neighboring vehicles or other radio resources may be considered. In particular, high density of radios on road can put a strain on the Carrier Sense Multiple Access with Collision-Avoidance (CSMA/CA) protocol employed for medium air-link access by 802.11p radios. Unlike 2G/3G/Long Term Evolution (LTE) radio networks in which scheduling of transmissions is tightly controlled by a base station, a Wi-Fi CSMA/CA protocol employed for Medium Access Control (MAC) layer is non-deterministic with stations. Here, a transmitter station senses a medium prior to its transmission and further detects simultaneous transmissions which may cause data collisions with its transmission if any, and retransmits potentially corrupted packets involved in the data collisions if such data collisions occur. An efficiency of CSMA/CA network may degrade under heavy data traffic from too many stations. Finally, strong dependency of DSRC performance on performance of vehicle-installed antennas may complicate radio performance assessment.

Based on the above, assessment of usability of crash warning applications with DSRC was conducted to identify critical use cases. In this assessment, a DSRC module for the US market with a frequency band of 5.9 GHz with output power around 20 dBm was employed. Detailed conditions are listed in Table 1.

TABLE 1

| Measurement Conditions | |
|---|---|
| Conditions/Parameters | Value/Results |
| Frequency | 5890 MHz (Channel 178), Channel Width = 10 MHz |
| Output Power | 20 dBm |
| Antenna architecture | Diversity (Not MIMO) |
| PER (Packet Error Rate) | Count on physical layer (without multiple continuous transmission) |
| Count | Used a counter provided by a DSRC radio supplier |
| Antennal Installation | Tx Vehicle: Mercedes Benz - sedan<br>Rx Vehicle: Toyota Camry - sedan |
| Base-line test | LOS (Line of Sight) ¼ miles (~400m): PER = 0.8% |

A test signal was transmitted from Tx Vehicle to Rx Vehicle under the conditions in Table 1 and with several obstacle conditions listed in Table 2 and the transmission result was compared with the result of the Base-line test listed in Table 1.

TABLE 2

| Performance test conditions | | | | | |
|---|---|---|---|---|---|
| Conditions | Vehicle 1 | Vehicle 2 | Building - case 1 | Building - case 2 | Building - case 3 |
| Dimension | Tx-Rx: 2.6m | Tx-Rx: 5.2m | Tx-corner: 0m<br>Rx-corner: 15m | Tx-corner: 15m<br>Rx-corner: 15m | Tx-corner: 30m<br>Rx-corner: 30m |
| Obstacles | Beyond busses/ trucks | Beyond busses/ trucks | Beyond a building without reflection signal | Beyond a building without reflection signal | Beyond a building without reflection signal |
| Geometry in FIG. 1 | (a) | (b) | (c) | (d) | (e) |
| Error rate | 0.1% | 0.1% | 0% | 47% | 87% |

When a building is located as an obstacle on a communication path between Tx Vehicle and Rx Vehicle as shown in FIGS. 1 (*d*) and (*e*), radio propagation degradation is significantly large with a packet error rate of 47% and 87% respectively, and an increase of radio output power or replacement to a lower frequency channel are likely to be effective in order to ensure the communication. On the other hand, when large vehicles such as buses or trucks are located as obstacles on a communication path between Tx Vehicle and Rx Vehicle as shown in FIGS. 1 (*a*) and (*b*), the packet error rate indicating the radio propagation degradation is merely about 0.1% and found negligible which is opposite to what was predicted and taught in patent references JP 2005-204218 and JP 2008-236409. Thus, the findings shown in Table 2 suggest that there still is a room for improving efficiency of transmissions by further optimizing radio frequency and intensity considering the less radio propagation degradation due to a vehicle type of obstacles between vehicles while considering significantly large radio propagation degradation due to a building type of obstacles between vehicles.

Figure 2:
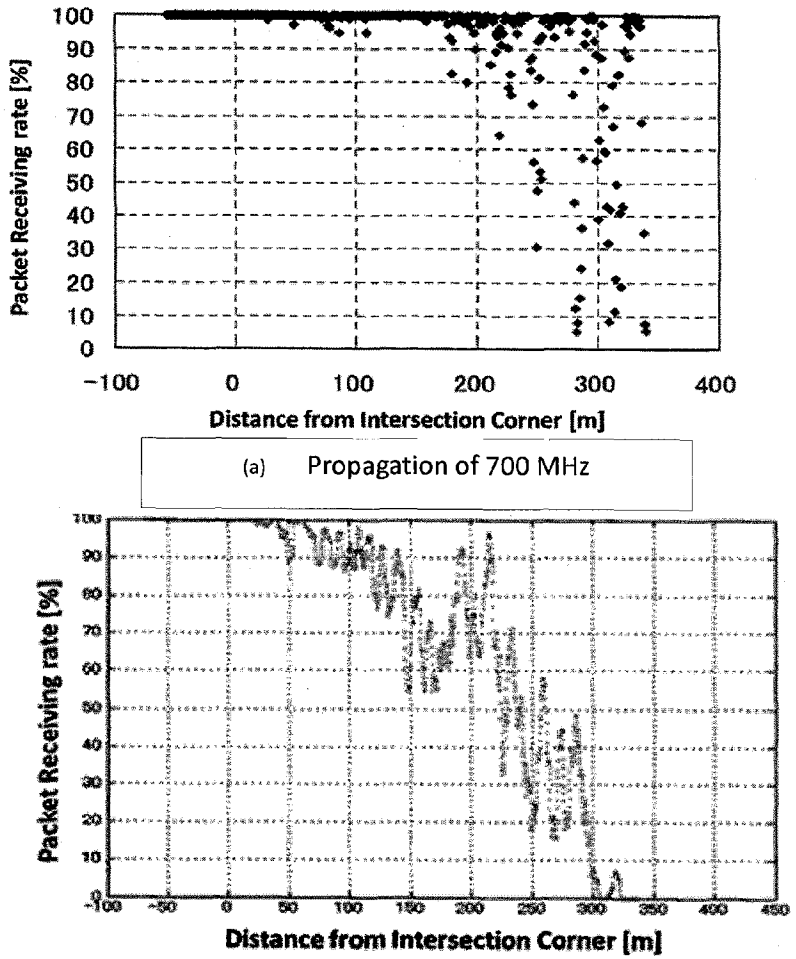
FIG. 2 shows signal characteristics based on relationships between a distance between two vehicles and an intersection corner and a measured packet receiving rate in communication between the two vehicles.

From the above, to achieve higher transmission performance against radio propagation degradation due to buildings around an intersection, either an increase of radio output power or replacement to a lower frequency channel is likely to be effective. As observed in FIGS. 2 (*a*) and (*b*) (excerpt from p. 22 of URL http://www.soumu.go.jp/main_content/000025424.pdf), presented by Japanese Ministry of Internal Affairs and Communications, using a lower frequency channel such as approximately 700 MHz instead of 5.8 GHz is likely to significantly improve the transmission performance for communication with the distance up to 150 m, increasing a packet receiving rate from 55% to over 90%. On the other hand, the considerably low packet error rate of 0.1% for vehicle obstacles in Table 2 teaches us to prohibit switching between frequency channels and signal intensity to efficiently transmit signals to surrounding vehicles over vehicles if a current transmission is already optimized for efficiency.

Figure 3:
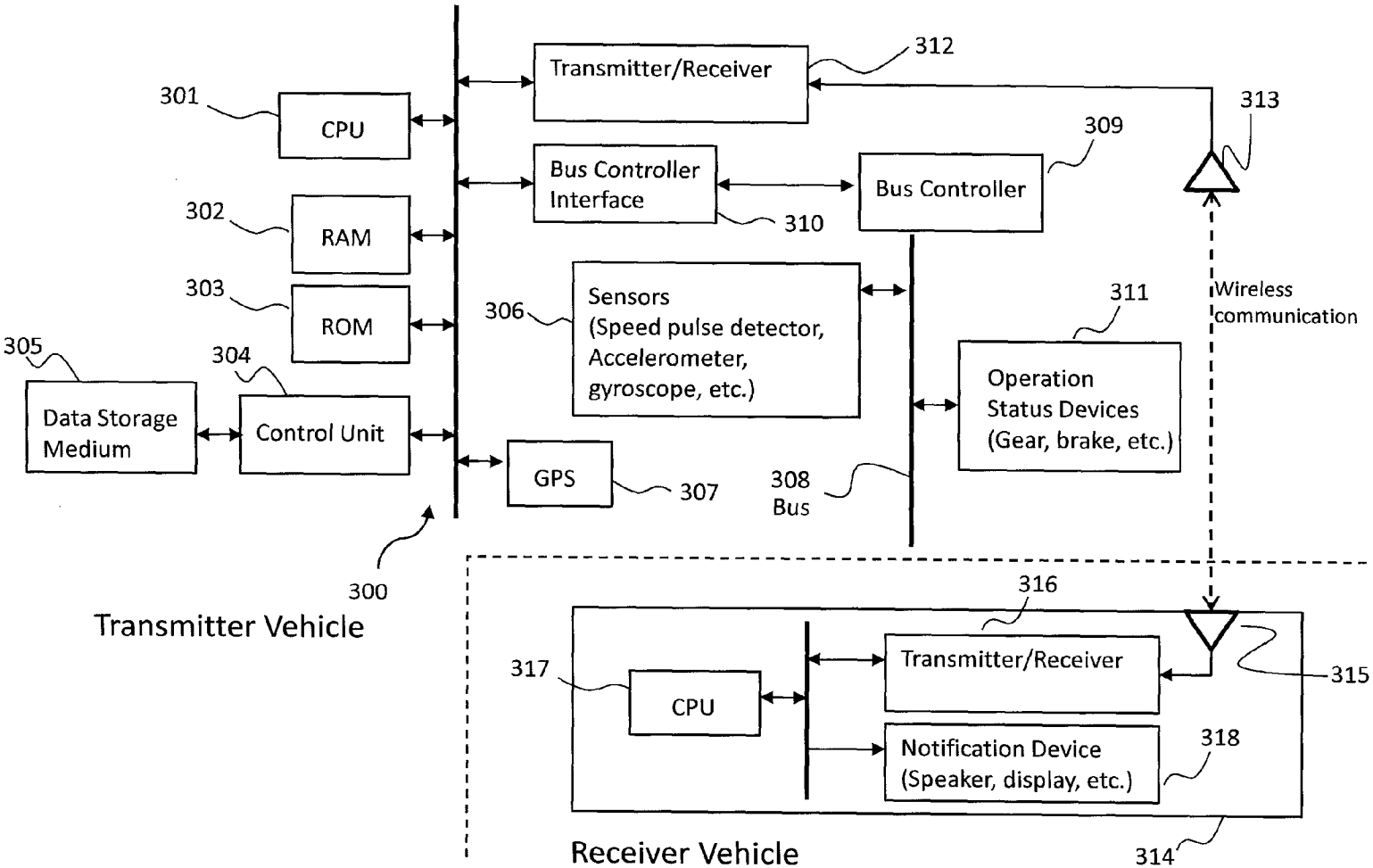
FIG. 3 is a block diagram of a vehicle to vehicle wireless communication apparatus with potential crash warning on a transmitter vehicle and its counterpart receiver vehicle according to one embodiment.

Considering the above findings, one embodiment is represented by a block diagram shown in FIG. 3. FIG. 3 is a block diagram of an in-vehicle communication system equipped for vehicle-to-vehicle communication. Note that the block diagram in FIG. 3 is merely an example according to one embodiment for an illustration purpose and not intended to represent any on particular architectural arrangement. The various embodiments can be applied to other type of in-vehicle communication system. For example, the in-vehicle communication system 300 includes a central processor unit (CPU) 301 for controlling an overall operation of the communication system, random access memory (RAM) 302 for temporally storing data such as map related data and vehicle related data and processing results for efficient handling of related information in accordance with this disclosure, and read only memory (ROM) 303 for storing various control programs, such as navigation related programs and vehicle related data acquisition programs, necessary for typical DSRC communication as well as communication parameter control of this disclosure.

The in-vehicle communication system 300 also includes a data storage medium 305 such as a hard disk in a hard disk drive (HDD), flash memory in a solid state drive (SSD) or universal serial bus (USB) key memory, a compact disc-read only memory (CD-ROM), a digital versatile disc (DVD) or other storage medium for storing map data. The in-vehicle communication system also includes a control unit 304 for controlling an operation for reading the information from the data storage medium 305. The in-vehicle communication system 300 may include or have access to a sensing device 306 in a vehicle and either inside or at proximity of the in-vehicle communication system 300 such as position/distance measuring device, for measuring a present vehicle position or user position, which may be transmitted to the receiver vehicle as well as used for determining vehicle environment considered for radio parameter control. For example, the sensing device 306 may have a vehicle speed sensor for detecting a moving distance, a gyroscope for detecting moving direction, a microprocessor for calculating a position. In addition, the in-vehicle communication system 300 may also include a global positioning system (GPS) 307 for receiving and analyzing GPS signals, etc. These sensors and GPS are connected by a bus system 308.

The in-vehicle communication system 300 accommodates a plurality of means for receiving inputs from in-vehicle devices. For example, the in-vehicle communication system 300 may include a bus controller 309 for coupling to in-vehicle devices via a bus 308 (e.g. Universal Serial Bus, CAN Bus, etc.) and a bus controller interface 310 handles received data from the in-vehicle devices. In one embodiment, the bus 308 may be used for receiving sensor data from in-vehicle sensors 306 as well as for receiving operation statuses from operation status devices 311 that provides current operation statuses of gear, brake, etc.

Furthermore, the in-vehicle communication system 300 may include a wireless transmitter/receiver 312. Using the wireless transmitter/receiver 312 via antennas 313 which is able to transmit signals of several radio frequency bands and intensity levels for this disclosure, the in-vehicle communication system 300 may communicate with external devices of surrounding vehicles, remote servers and networks, etc. In this embodiment, the wireless transmitter/receiver 312 may be used for transmitting the vehicle's position, speed, direction of driving, etc to the surrounding vehicles. A receiver vehicle also includes another wireless vehicle-to-vehicle communication device 314 similar to the in-vehicle communication system 300 also capable of receiving the signals of several radio frequency bands and intensity levels, having antennas 315 and a wireless transmitter/receiver 316. The information of the transmitter vehicle received by the receiver vehicle's wireless vehicle-to-vehicle communication device 314 is processed at a central processing unit (CPU) 317 considering the receiver vehicle's driving situation and the CPU 317 determines whether there may be a potential crash depending on the transmitter vehicle's driving behavior based on the received information and the receiver vehicle's driving behavior determined internally. A notification device 318 such as a beeper, a text-to-speech (TTS) synthesizer, and/or a graphic display notifies a driver in the receiver vehicle of potential crash, if the CPU 317 determines that there is a high likeliness of a potential crash with the transmitter vehicle.

Figure 4:
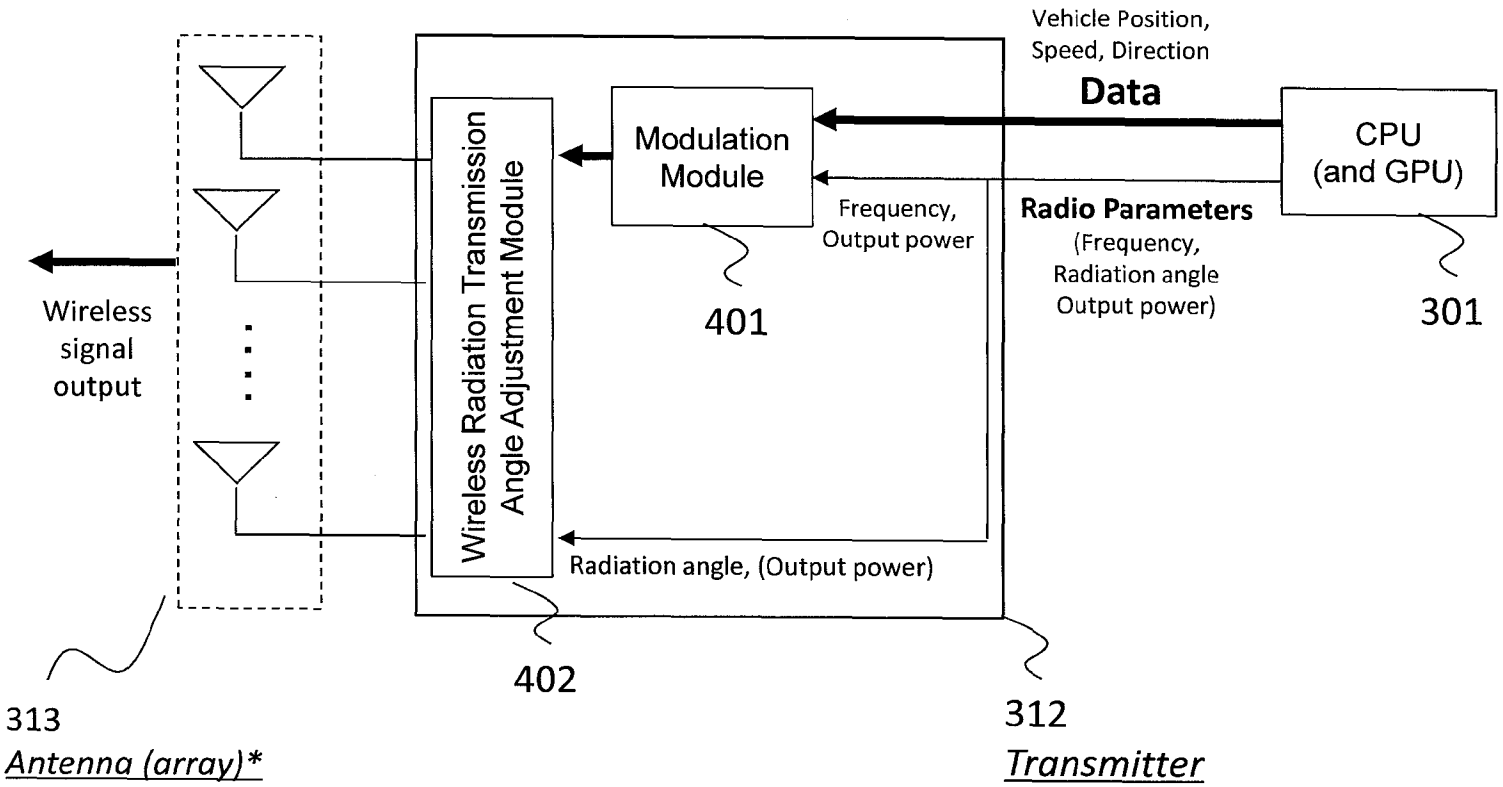
FIG. 4 is a close up block diagram of a transmitter block and an antenna block of the vehicle to vehicle wireless communication apparatus with potential crash warning according to one embodiment.

In one embodiment, as illustrated in FIG. 4, a modulation module 401 and a wireless radiation transmission angle adjustment module 402 may be included in the transmitter 312. The CPU 301 may send radio parameters including, but not limited to, a frequency, output radio signal intensity, and a radiation angle to the transmitter 312 together with data including a vehicle position, a speed of the vehicle, and a driving direction of the vehicle. In particular, the radio frequency and the output radio signal intensity may be transmitted to the modulation module 401 for radio signal modulation, and the radiation angle and the output radio signal intensity may be transmitted to the wireless radiation transmission angle adjustment module 402. The wireless radiation transmission angle adjustment module 402 may control the antennas 313 either by switching among a plurality of antennas of a plurality of directions or by beamfoaming where each antenna's output radio signal intensity is adjusted in order to control a beam angle of a whole set of antennas.

Figure 5:
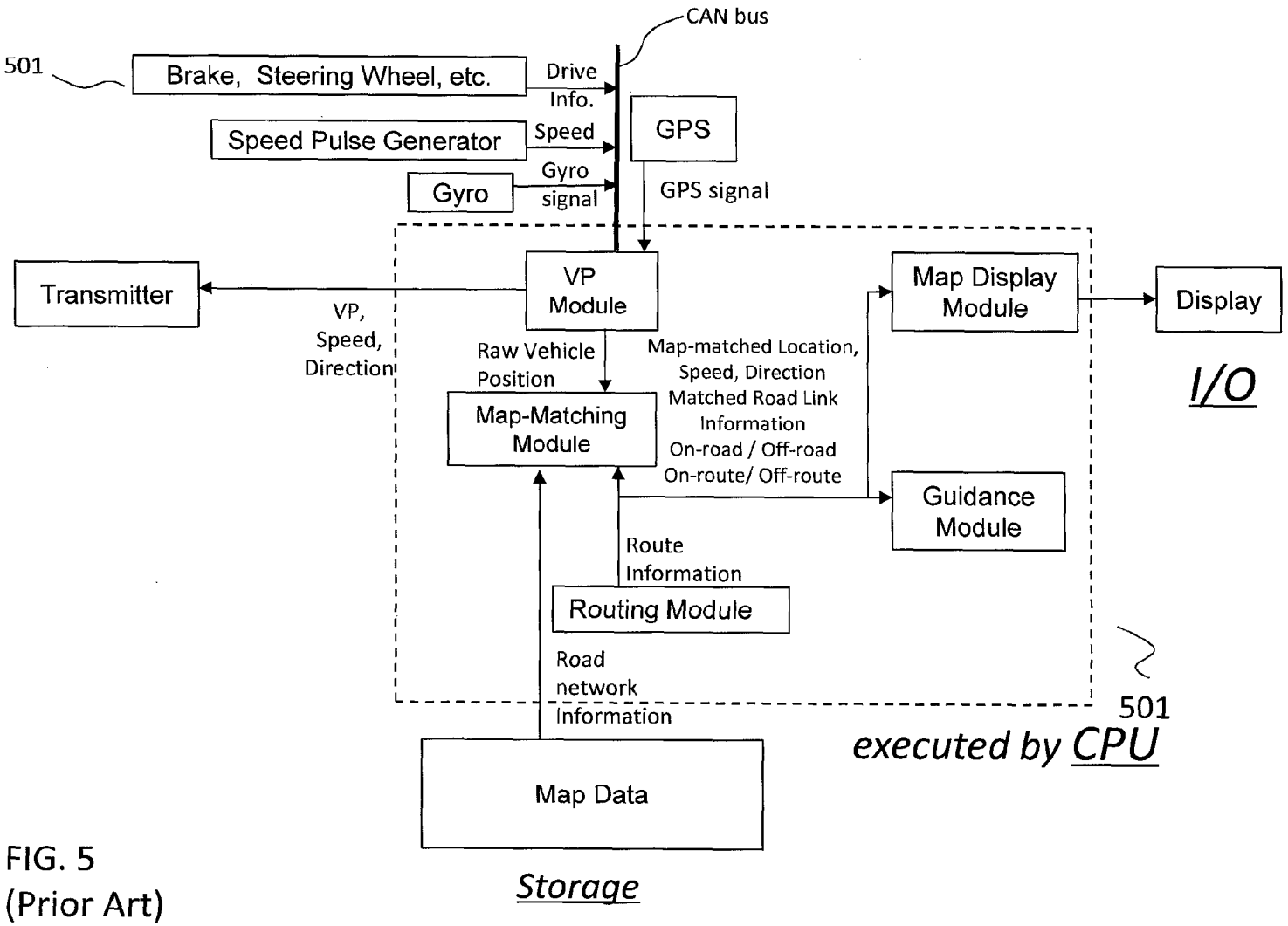
FIG. 5 (Prior Art)
FIG. 5 is a schematic diagram of a functional flow of a conventional vehicle to vehicle wireless communication apparatus with potential crash warning.

A software block diagram of a conventional wireless communication device for vehicle-to-vehicle communication in a vehicle navigation system equipped to a vehicle is illustrated in FIG. 5. As shown in FIG. 5, a vehicle positioning module receives at least one of a speed of the vehicle, a gyro signal, and a global positioning system (GPS) signal from a speed pulse generator, a gyroscope, and a GPS, respectively either via a bus or directly. Based on the received information, the vehicle positioning module detects a current vehicle position and a direction of driving and merely transmits the received current vehicle speed, the current vehicle position and the direction of driving to a transmitter for vehicle-to-vehicle communication in the conventional system. Here, the transmission signal characteristics are substantially constant because there is no control of the signal characteristics.

Figure 6:
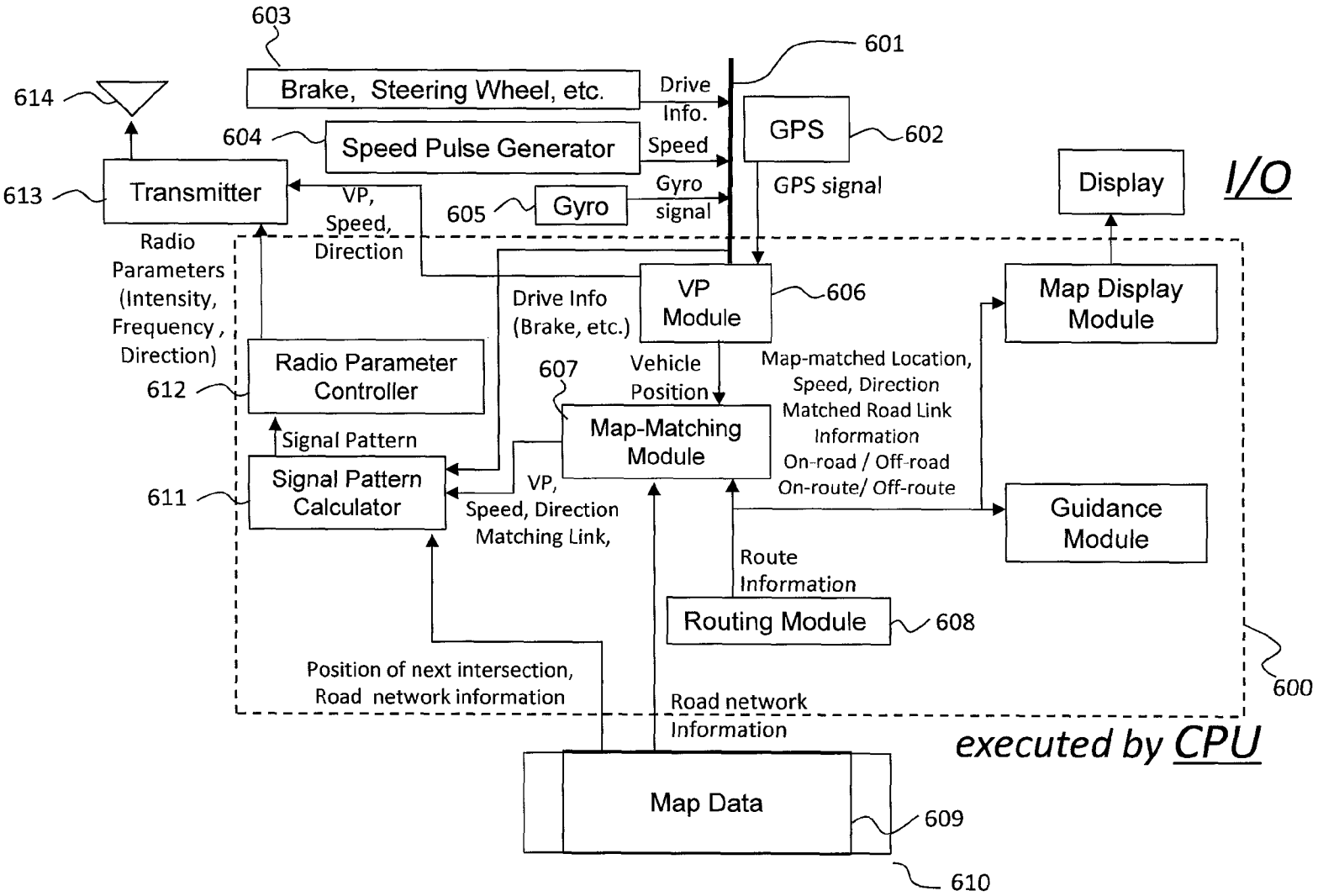
FIG. 6 is a schematic diagram of a functional flow of a vehicle to vehicle wireless communication apparatus with potential crash warning according to one embodiment.

A software block diagram of one embodiment of a wireless communication device for vehicle-to-vehicle communication in a vehicle is illustrated in FIG. 6. A vehicle positioning module 606 receives at least one of a speed of the vehicle, a gyro signal, and a global positioning system (GPS) signal from a speed pulse generator 604, a gyroscope 605, and a GPS 602, respectively either via a bus 601 or directly. Based on the received information, the vehicle positioning module 606 detects a current vehicle position and a direction of driving.

The obtained vehicle position is forwarded to a map matching module 607. The map matching module retrieves pre-calculated route information calculated by a routing module 608 and road network information based on the current position of the first vehicle in the stored map data 609 in storage 610 and identifies a current link that includes the current vehicle position. The map-matching module 607 sends the current vehicle position, the speed and the direction of the vehicle, matching link road information based on the identified current link where the vehicle is located to a signal pattern calculation module 611.

The signal pattern calculation module 611 receives the current vehicle position, the speed and direction of the vehicle and the current link from the map matching module, and receives a position of next intersection and the road network information in the map data 609 from the storage 610 based on the received current vehicle position, the direction of the vehicle and the current link from the map matching module 607. Based on the received information above, the signal pattern calculation module 611 to determine a potential signal pattern. For example, if the signal pattern calculation module 611 determines that a current vehicle position is in the middle of a current link where the vehicle is likely to communicate with other vehicles in the proximity of the vehicle including some vehicles on the same street beyond other surrounding vehicles, a potential signal pattern with efficiency particular to the environment for communication with vehicles beyond the surrounding vehicles is still found effective and may be selected instead of directional radio signals with low radio frequency and high radio signal intensity. In another situation, if the signal pattern calculation module 611 receives a position of next intersection and the road network information in the map data 609 from the storage 610 based on the received current vehicle position, the direction of the vehicle and the current link from the map matching module 607 and determines that the vehicle is approaching to the next intersection within a certain time, e.g. 5 seconds-12 seconds, the signal pattern calculation module 611 determines a potential signal pattern specific for approaching to an intersection in a threshold time, such as an alert type of "Intersection Movement Assist (IMA)" defined by the U.S. Department of Transportation (DOT) in case when the vehicle is driving straight alerting to surrounding vehicles on the street intersecting, and an alert type of "Left Turn Assist (LTA)" defined by the U.S. DOT in case when the vehicle is turning left at the intersection.

In another situation, if the signal pattern calculation module 611 obtains driving information from one or more drive operation devices 603 such as brakes, a steering wheel, and so on, it is possible to determine the potential signal pattern. In one embodiment, the signal pattern calculation module 611 determines a potential signal pattern for signaling rearward with an alert type of "Emergency Electronic Brake Light (EEBL)" for nearby receiver vehicles when each line of sight of each nearby receiver vehicle is obstructed by other vehicles or bad weather conditions defined by the U.S. DOT in order to avoid collision due to a sudden braking, if the sudden braking is detected. If sudden steering wheel operation is found which diverts the vehicle from the pre-calculated route, a potential signal pattern for directionally signaling to objects, including vehicles (and possible pedestrians) in the vehicle's driving direction based on the steering wheel operation in order to avoid any possible accident. Sudden acceleration may be considered by the signal pattern calculation module 611 to determine a potential signal pattern with an alert type of "Forward Collision Warning (FCW)" defined by the U.S. DOT to the vehicles behind. Likewise, the driving status information related to a driver action, such as a sudden change of at least one of the speed of the vehicle and direction of the vehicle, may be used for determining a directional and intensity control of the radio signal.

A radio parameter controlling module 612 receives the potential signal pattern from the signal pattern calculation module 611 and assigns a set of radio parameters including a level of radio intensity, a radio frequency, and a direction of a radio signal based on the potential signal pattern in order to control the level of radio intensity, the radio frequency, and the direction of radio signal to be handled at a transmitter 613 and an antenna module 614 controlled by the transmitter 613.

The transmitter 613 generates a radio signal of the level of radio intensity, the radio frequency, and the direction of radio signal assigned by the radio parameter controlling module 612. In the radio signal, the current position, speed and driving direction of the vehicle are typically included to be transmitted. However, other data than the above can also be transmitted.

The antenna module 614 may include a plurality of antennas, which convert the radio signal from the transmitter 613 into radio waves and radiate the radio waves. In one embodiment, the direction of the radio signal may be controlled by switching among the plurality of antennas of a plurality of directions. In another embodiment, the direction of the radio signal may be controlled by beam foaming at the antenna module 614.

Figure 7:
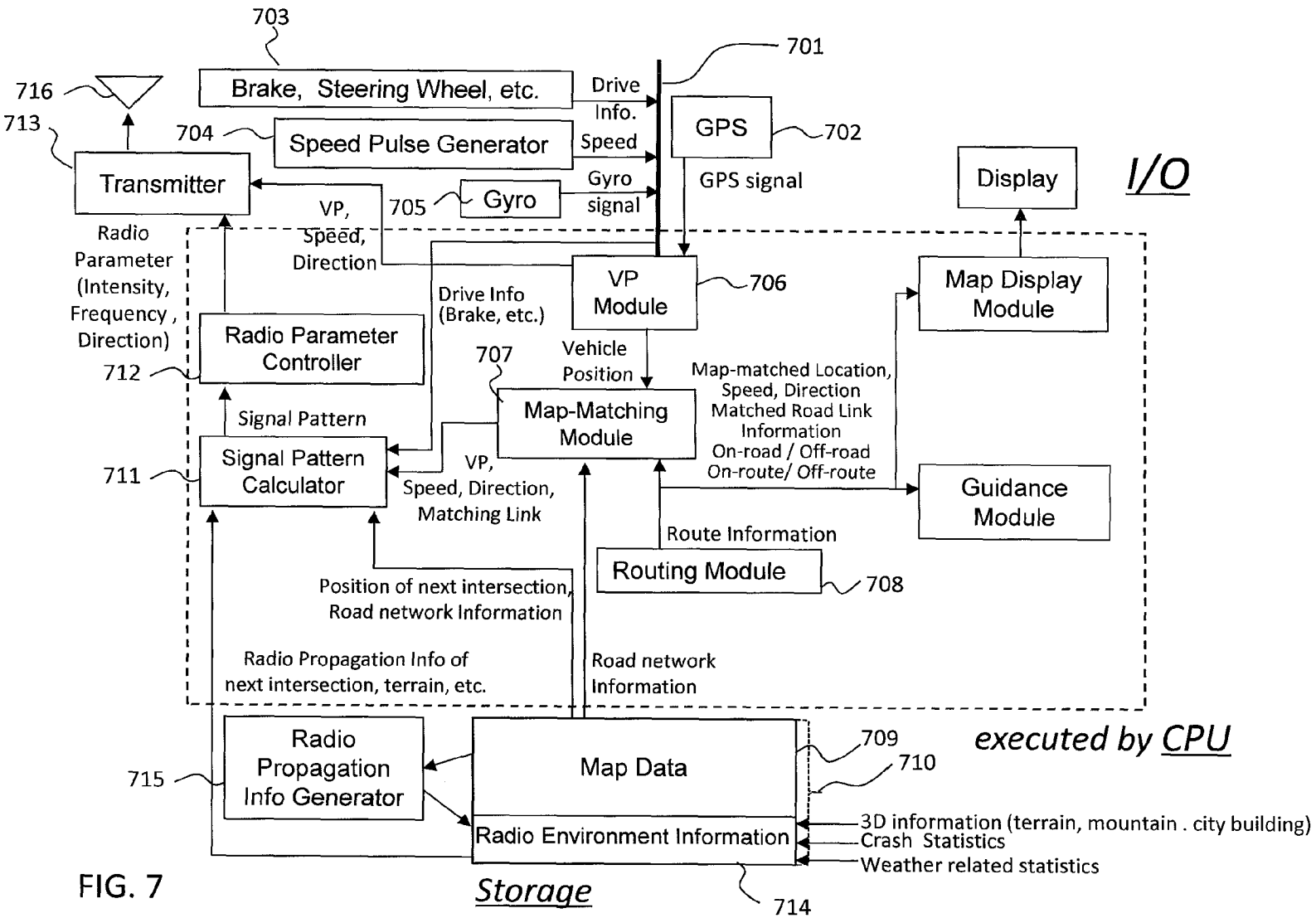
FIG. 7 is a schematic diagram of a functional flow of a vehicle to vehicle wireless communication apparatus with potential crash warning according to one embodiment with radio environment information.
Figure 8:
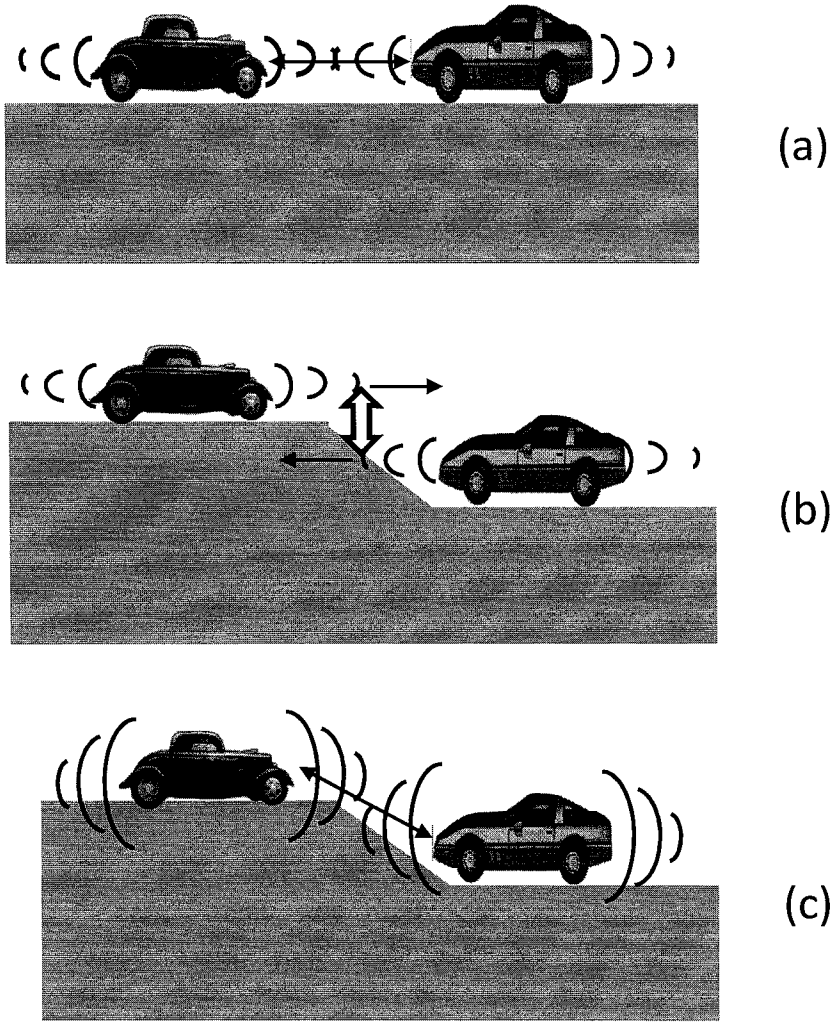
FIG. 8 shows schematic views positional relationships between vehicles on different altitudes and directional signal characteristics.

In another embodiment shown in FIG. 7, a different type of conditions such as radio propagation environment may be considered. For example, if the current vehicle position is in a mountainous or hilly area where the vehicle is supposed to communicate with other vehicles having different altitude, it may be more effective to optimize signal characteristics considering an elevation effect on performance of antenna due to difference in altitude between two vehicles. For example, the antenna's profile and performance of the antenna installed in the vehicle may significantly affect its radio propagation performance, and thus may impact on a design and usability of crash warning applications which uses vehicle to vehicle communication. In particular, because the vehicle tends to ordinarily communicate in a substantially horizontal plane, the vehicle communication device is designed to optimize the communication on the substantially horizontal plane as shown in FIG. 8(*a*). However, it is not optimal for communication in mountainous or hilly areas and the vertical antenna profile impacts on the application usability in a case of the vehicles on different altitudes as shown in FIG. 8 (*b*). On the other hand, too strong antenna peak gains are given to achieve successful communication in a vertical direction without directional signal control, the signal tends to interfere with communications between neighboring vehicles and other wireless communications with adjacent wireless spectrums. Thus, optimal control of antenna performance profiles as shown in FIG. 8 (*c*) may be desired.

A software block diagram of one embodiment of a wireless communication device for vehicle-to-vehicle communication in a vehicle to achieve such optimization of antenna performance for communication in mountainous or hilly areas is illustrated in FIG. 7. Here, a vehicle positioning module 706 receives at least one of a speed of the vehicle, a gyro signal, and a global positioning system (GPS) signal from a speed pulse generator 704, a gyroscope 705, and a GPS 702, respectively either via a bus 701 or directly. Based on the received information, the vehicle positioning module 706 detects a current vehicle position and a direction of driving.

The obtained vehicle position is forwarded to a map matching module 707. The map matching module retrieves pre-calculated route information calculated by a routing module 708 and road network information based on the current position of the first vehicle in the stored map data 709 in storage 710 and identifies a current link that includes the current vehicle position. The map-matching module 707 sends the current vehicle position, the speed and the direction of the vehicle, matching link road information based on the identified current link where the vehicle is located to a signal pattern calculation module 711.

To achieve sufficient antenna performance for communication in mountainous or hilly areas, enhancement of radio intensity in a vertical direction may be applied once the signal pattern calculation module 711 receives radio propagation information 714 in the map database and determines that the current vehicle position is in a mountainous or hilly area where the vehicle is supposed to communicate with other vehicles having a different altitude. One example of such embodiment is to design an antenna set with radio performance shown in Table 3 and FIG. 9. Table 3 and FIG. 9 show an antenna performance of one embodiment for each directional profile under a condition of radio frequency of 5.9 GHz, where the antenna is installed at an ordinary sharkfin position of GM Buick.

TABLE 3

Antenna Performance and Directional profile

Figure 9:
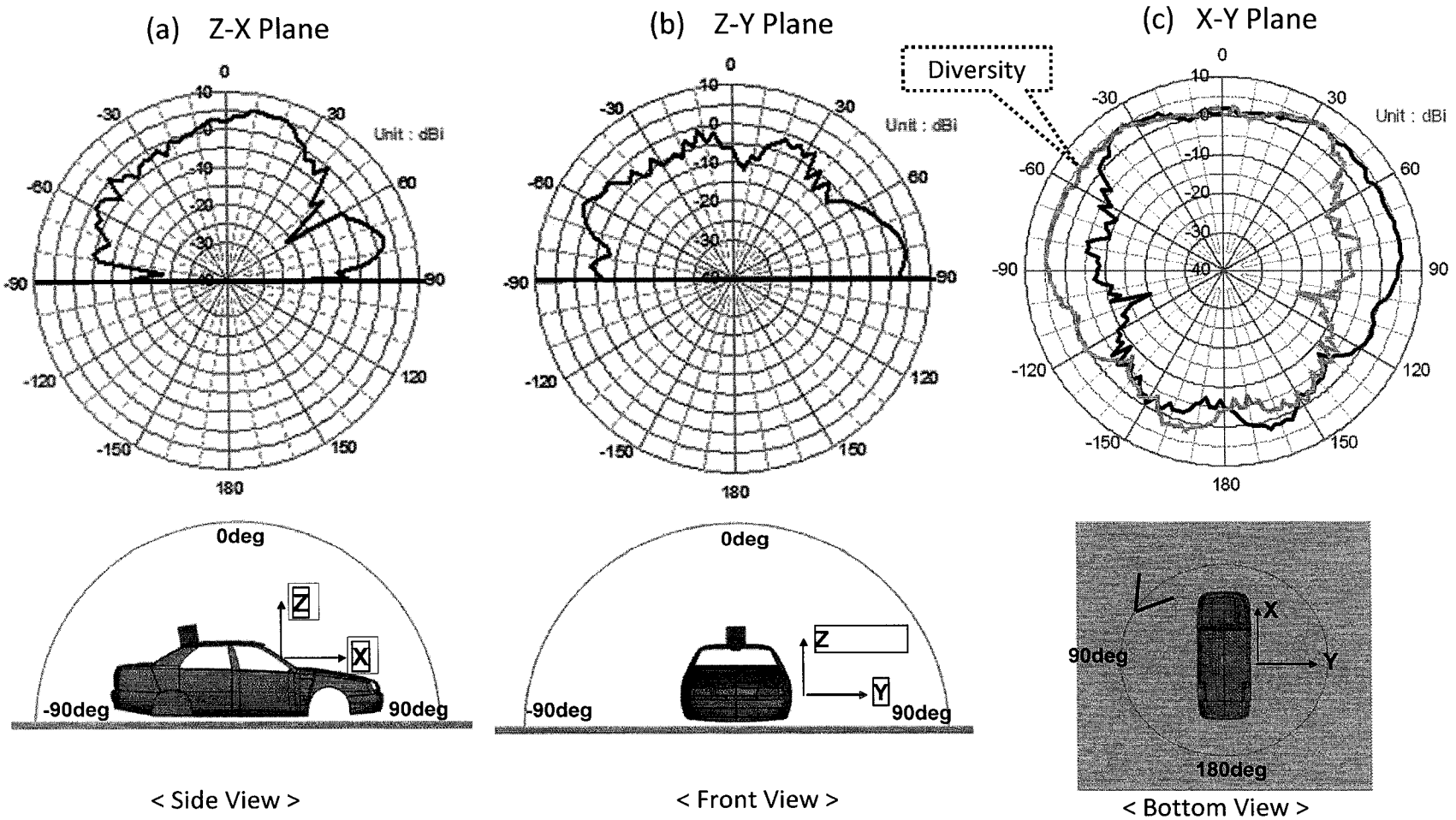
FIG. 9 shows schematic views of signal directional planes of a vehicle and respective signal characteristics according to one embodiment.

| Plane (profile) | Z-X plane | Z-Y plane | X-Y plane |
|---|---|---|---|
| Geometry in FIG. 8 | (a) | (b) | (c) |
| Signal directional planes schematics and characteristics in FIG. 9 | (a) | (b) | (c) |
| Peak Gain [dBi] | 5.8 | 4.4 | 5.1 |
| Average Gain [dBi] | −0.2 | −1.7 | 0.8 |

In another embodiment, the radio propagation information generating module 715 may further create radio propagation information 714 based on map data 709 from map database storage 710. For example, the radio propagation information 714 may be created based on three dimensional information having at least one of terrain information, mountain polygonal information, city polygonal information and intersection information. For example, based on intersection information and building information surrounding the intersection, the radio propagation information around the intersection area may be created using multipath and Doppler simulation method, such as ray-tracing or statistical channel modeling. Alternatively, the radio propagation information 714 may be created externally, such as a map server and can be downloaded in advance. In another embodiment, the radio propagation information 714 may be obtained from the map databases already available, such as coverage map database owned by a mobile phone service provider. In any case, using the radio propagation information 714, mountain polygonal information may be associated with enhancement of a radio performance in a vertical direction in mountain areas, and elevation data at vehicle location may be associated with enhancement of the radio performance in a vertical direction in large slope areas. Thus, the signal pattern calculation module 711 may determine the potential signal pattern indicative of the radio intensity enhancement in a vertical direction, if the altitude difference with another communication counterpart vehicle is predicted from information obtained from the map database storage 710.

Furthermore, it is possible to obtain the radio propagation information which is based on crash statistical information associated with location information. For example, in the United States, past crash statistical information linked with map data has been provided by National Highway Traffic Safety Administration (NHTSA). Alternatively, it is possible to obtain the radio propagation information that is based on weather statistical information associated with location information. For example, signals with higher frequency are more likely to be affected by moisture, such as fog, rain or snow which causes attenuation and signal degradation. Thus, when the signal pattern calculation module 711 receives radio propagation information 714 in the map database related to current weather information indicative of fog, rain or snow, the signal pattern calculation module 711 may select the potential signal pattern with enhanced intensity or lowered frequency.

The potential signal patterns listed above are merely examples. Basically, if signal degradation in particular situation is considered significantly low, a radio frequency, a radio signal intensity and a direction of signal by default are considered to be sufficient and these values are assigned. On the other hand, if a special situation, such as the vehicle is arriving at the next intersection within a threshold time occurs, a level of radio intensity higher than the default level of radio intensity, a radio frequency lower than the default radio frequency are assigned to a directional radio signal, in order to signal to an area within a predetermined distance from the next intersection on an intersecting street at the next intersection.

TABLE 4

Alert type categorized by USDOT and optimal wireless radio parameters

| Situation (USDOT Alert type) | Wireless Preferred | Wireless Parameters | | |
|---|---|---|---|---|
| | | Frequency | Intensity | Direction |
| Approaching to Intersection: to the vehicles on intersecting street (IMA) | Strong propagation | Low e.g. 700 MHz | Large | Front & Front-side focus |
| Approaching to Intersection (to turn left): to the vehicles in the driving direction (LTA) | Propagation optimal with minimum interference | High e.g. ≥5 GHz | Small | Front & Front-side focus |
| To the vehicles in the driving direction (DNPW) | | | | |
| From the vehicles in blind Spots (BSW) | | | | Front, Front-side, and Side focus |
| Sudden braking or deceleration: to the surrounding vehicles rearward (EEBL, FCW) | | | | Rear (from Front to Rear) |

A radio parameter controlling module 712 receives the potential signal pattern from the signal pattern calculation module 711 and assigns a set of radio parameters including a level of radio intensity, a radio frequency, and a direction of a radio signal based on the potential signal pattern in order to control the level of radio intensity, the radio frequency, and the direction of radio signal to be handled at a transmitter 713 and an antenna module 716 controlled by the transmitter 713. For example, as shown in Tables 3 and 4, depending on the potential signal pattern, a preferred set of radio parameters including a level of radio intensity, a radio frequency, and a direction of a radio signal may be set.

In one embodiment, the radio parameter controlling module 712 receives the determined potential signal pattern from the signal pattern calculation module 711. For example, if the potential signal pattern with efficiency particular to the environment for communication with vehicles beyond the surrounding vehicles has been received, the radio parameter controlling module 712 sets the set of radio parameters including the high radio frequency, low radio signal intensity without specific directionality instead of directional radio signals with low radio frequency and high radio signal intensity. In another situation, if the radio parameter controlling module 712 receives the determined potential signal pattern specific for approaching to an intersection in a threshold time from the signal pattern calculation module 711, a set of radio parameters for front-focus and front-side focus directional radio signals with low radio frequency and high radio signal intensity can be selected for alerting to surrounding vehicles on the street intersecting.

In another example, if the radio parameter controlling module 712 receives the potential signal pattern from the signal pattern calculation module 711, relevant to driving information from one or more drive operation devices 703 such as brakes, a steering wheel, an accelerator etc., the potential signal pattern may be for signaling rearward, directionally signaling to objects including vehicles (and possible pedestrians) in the vehicle's driving direction based on the steering wheel operation and acceleration and the radio parameter controlling module 712 sets the set of radio parameters including the high radio frequency, low radio signal intensity with specific directionality according to the potential signal pattern. Thus, the driving status information related to a driver action, such as a sudden change of at least one of the speed of the vehicle and direction of the vehicle, may be used for determining a directional and intensity control of the radio signal. Some of the potential signal patterns and optimized wireless parameters in one embodiment are also listed in Table 4.

In another example, if the radio parameter controlling module 712 receives the potential signal pattern from the signal pattern calculation module 711, related to radio propagation environment indicating communication in mountainous or hilly areas, enhancement of radio intensity in a vertical direction may be applied to achieve the performance of Table 3.

The transmitter 713 generates a radio signal of the level of radio intensity, the radio frequency, and the direction of radio signal assigned by the radio parameter controlling module 712. In the radio signal, the current position, speed and driving direction of the vehicle are typically included to be transmitted. However, other data than the above can also be transmitted.

The antenna module 716 typically includes a plurality of antennas, which convert the radio signal from the transmitter 713 into radio waves and radiate the radio waves. In one embodiment, the direction of the radio signal may be controlled by switching among the plurality of antennas of a plurality of directions. In another embodiment, the direction of the radio signal may be controlled by beam foaming at the antenna module 716.

Although this invention has been disclosed in the context of certain preferred embodiments and examples, it will be understood by those skilled in the art that the inventions extend beyond the specifically disclosed embodiments to other alternative embodiments and/or uses of the inventions and obvious modifications and equivalents thereof. In addition, other modifications which are within the scope of this invention will be readily apparent to those of skill in the art based on this disclosure. It is also contemplated that various combination or sub-combination of the specific features and aspects of the embodiments may be made and still fall within the scope of the inventions. It should be understood that various features and aspects of the disclosed embodiments can be combined with or substituted for one another in order to form varying mode of the disclosed invention. Thus, it is intended that the scope of at least some of the present invention herein disclosed should not be limited by the particular disclosed embodiments described above.

The invention claimed is:

1. A wireless communication device for vehicle-to-vehicle communication in a first vehicle, comprising:

a vehicle positioning module configured to receive at least one of a speed of the first vehicle, a gyro signal, and a global positioning system (GPS) signal from one or more sensors and to detect a current position of the first vehicle and a direction of the first vehicle;

storage configured to store map data;

a map matching module configured to retrieve pre-calculated route information and road network information based on the current position of the first vehicle from the stored map data and to identify a current link comprising the current position of the first vehicle;

a signal pattern calculation module configured to receive the current position of the first vehicle, the speed of the first vehicle, the direction of the first vehicle, and the current link from the map matching module, to receive a position of next intersection and the road network information based on the received current position of the first vehicle the direction of the first vehicle, the current link from the map matching module, to determine a potential signal pattern;

a radio parameter controlling module configured to receive the potential signal pattern from the signal pattern calculation module, to assign a level of radio intensity, a radio frequency, and a direction of a radio signal based on the potential signal pattern, and to control the level of radio intensity, the radio frequency, and the direction of radio signal;

a transmitter configured to produce a radio signal of the level of radio intensity, the radio frequency, and the direction of radio signal assigned by the radio parameter controlling module, the radio signal comprising the current position of the first vehicle, the speed of the first vehicle, and the direction of the first vehicle; and an antenna module comprising a plurality of antennas, configured to convert the radio signal from the transmitter into radio waves and to radiate the radio waves, wherein the signal pattern calculation module is configured to determine the potential signal pattern which allows the radio parameter controlling module to assign a first level of radio intensity and a first radio frequency to the radio signal and to further assign a second level of radio intensity higher than the first level of radio intensity, a second radio frequency lower than the first radio frequency to a radio signal with a direction to an area within a predetermined distance from the next intersection on an intersecting street at the next intersection when the potential signal pattern is indicative that the first vehicle arriving at the next intersection within a threshold time, and wherein the determined potential signal pattern is configured to allow the radio parameter controlling module to assign a first level of radio intensity and a first radio frequency to the radio signal transmitted to a second vehicle travelling on a street where the first vehicle is travelling when an obstacle is in between the first vehicle and the second vehicle.

2. The wireless communication device of claim 1, wherein the direction of the radio signal is controlled by switching among a plurality of antennas of a plurality of directions.

3. The wireless communication device of claim 1, wherein the direction of the radio signal is controlled by beam foaming.

4. The wireless communication device of claim 1, wherein the signal pattern calculation module is further configured to receive radio propagation information from a map database and to determine the potential signal pattern based on the radio propagation information.

5. The wireless communication device of claim 4, wherein the radio propagation information is based on three dimensional information comprising at least one of terrain information, mountain polygonal information, city polygonal information and intersection information.

6. The wireless communication device of claim 4, wherein the radio propagation information is based on crash statistical information associated with location information.

7. The wireless communication device of claim 4, wherein the radio propagation information is based on weather statistical information associated with location information, and stored in the map database.

8. The wireless communication device of claim 1, further comprising a radio propagation information generating module, wherein the radio propagation information generating module is configured to create radio propagation information based on received information from a map database; and wherein the signal pattern calculation module is further configured to determine the potential signal pattern based on the radio propagation information received from the radio propagation information generating module.

9. The wireless communication device of claim 1, wherein the driving status information is related to a driver action related to a sudden change of at least one of the speed of the vehicle and the direction of the vehicle, and wherein the signal pattern calculation module is configured to further determine the potential signal pattern considering the driving status information which allows the radio parameter control module to control a direction and intensity based on the driving status information.

10. The wireless communication device of claim 9, wherein the radio parameter controller is configured to assign the first level of radio intensity and the first radio frequency to the radio signal with a direction rearward when the driving status information is indicative of the sudden decrease of the speed.

11. A transmission method of wireless vehicle-to-vehicle communication, comprising:

receiving at least one of a speed of a vehicle, a gyro signal, and a global positioning system (GPS) signal from one or more sensors;

detecting a current position of the vehicle and a direction of the vehicle;

retrieving pre-calculated route information and road network information based on the current position of the vehicle from map data in storage;

identifying a current link comprising the current position of the vehicle;

receiving the current position of the vehicle, the speed of the vehicle, the direction of the vehicle and the current link;

receiving a position of next intersection and the road network information based on the received current position of the vehicle, the direction of the vehicle, the current link;

determining a potential signal pattern based on the position of next intersection, the current position of the vehicle, the speed of the vehicle, the direction of the vehicle, the current link, and the road network information;

receiving the potential signal pattern;

assigning a first level of radio intensity, a first radio frequency, and a first direction of a radio signal based on the potential signal pattern;

controlling the first level of radio intensity, the first radio frequency, and the first direction of radio signal;

producing a radio frequency signal comprising the current position of the vehicle, the speed of the vehicle, and the direction of the vehicle at a transmitter;

converting the radio frequency signal into radio waves; and radiating the radio waves from one or more antennas, wherein assigning the level of radio intensity, the radio frequency, and the direction of the radio signal based on the potential signal pattern further comprises:

assigning a second level of radio intensity higher than the first level of radio intensity and a second radio frequency lower than the first radio frequency to a radio signal with a direction to an area within a predetermined distance from the next intersection on an intersecting street at the next intersection when the potential signal pattern is indicative that the vehicle arriving at the next intersection within a threshold time; and assigning the first level of radio intensity and the first radio frequency to the radio signal addressing to a second vehicle travelling on a street where the vehicle is travelling when an obstacle is in between the vehicle and the second vehicle.

12. The transmission method of claim 11, wherein controlling the direction of radio signal of the transmitter comprises switching among the one or more antennas of a plurality of directions.

13. The transmission method of claim 11, wherein controlling the direction of radio signal of the transmitter comprises beam foaming of the one or more antennas.

14. The transmission method of claim 11, wherein receiving the position of next intersection based on the received the current position of the vehicle, the speed of the vehicle, the direction of the vehicle, the current link, and the road network information further comprises:

receiving radio propagation information from a map database; and determining the potential signal pattern based on the radio propagation information.

15. The transmission method of claim 11, further comprising:

creating radio propagation information from a map database; and determining the potential signal pattern based on the radio propagation information.

16. The transmission method of claim 15, wherein the radio propagation information is based on three dimensional information comprising at least one of terrain information, mountain polygonal information, city polygonal information and intersection information.

17. The transmission method of claim 15, wherein the radio propagation information is based on crash statistical information associated with location information.

18. The transmission method of claim 15, wherein the radio propagation information is based on weather statistical information associated with location information.

19. The transmission method of claim 11, wherein the driving status information is related to a driver action related to a sudden change of at least one of the speed or direction of the vehicle, and determining the potential signal pattern further considering the driving status information for controlling a direction and intensity based on the driving status information.

20. The transmission method of claim 19, wherein controlling a direction and intensity based on the driving status information comprises assigning the first level of radio intensity and the first radio frequency to the radio signal with a direction rearward when the driving status information is indicative of the sudden decrease of the speed.

* * * * *